United States Patent [19]

Crowell et al.

[11] 4,081,006

[45] Mar. 28, 1978

[54] FLUID DISPENSING AND MIXING APPARATUS

[75] Inventors: John Arnold Crowell, Wilmington; Jean René Boutin, Hockessin, both of Del.

[73] Assignee: E. I. Du Pont de Nemours and Company, Wilmington, Del.

[21] Appl. No.: 741,038

[22] Filed: Nov. 11, 1976

[51] Int. Cl.[2] ..... B07B 7/28

[52] U.S. Cl. ..... 141/330; 222/83.5; 222/145; 222/148

[58] Field of Search ..... 222/82, 83, 83.5, 129.2, 222/148, 389, 145; 141/91, 19, 330

[56] References Cited

U.S. PATENT DOCUMENTS

| | | | |
|---|---|---|---|
| 923,550 | 6/1909 | Mikorey | 222/389 |
| 2,024,208 | 12/1935 | Daschner | 222/83 X |
| 2,144,702 | 1/1939 | Hulme | 222/83 X |
| 2,618,407 | 11/1952 | Thorn | 222/83 X |
| 3,139,343 | 6/1964 | Baselt | 222/83.5 X |
| 3,348,734 | 10/1967 | Rice et al. | 222/148 X |
| 3,788,519 | 1/1974 | Mengel | 222/83.5 |

*Primary Examiner*—Robert B. Reeves
*Assistant Examiner*—Charles A. Marmor

[57] ABSTRACT

A hydraulically actuated knife punctures a container of chemicals, dispenses them to a storage reservoir and simultaneously therewith dilutes and mixes the chemicals with water. Next, a spray directed along the knife automatically washes the interior of the container to insure that all of the chemicals are removed. Once the container is punctured, the contents of the container spill down over and about the knife and into the storage reservoir. When the hydraulic pressure is released, the knife, which is springloaded when actuated, returns to its original position.

11 Claims, 3 Drawing Figures

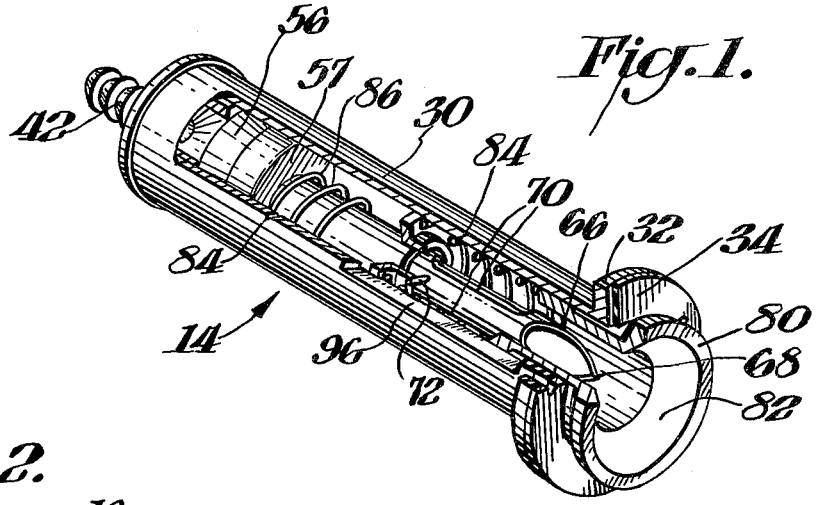
Fig. 1.
Fig. 2.
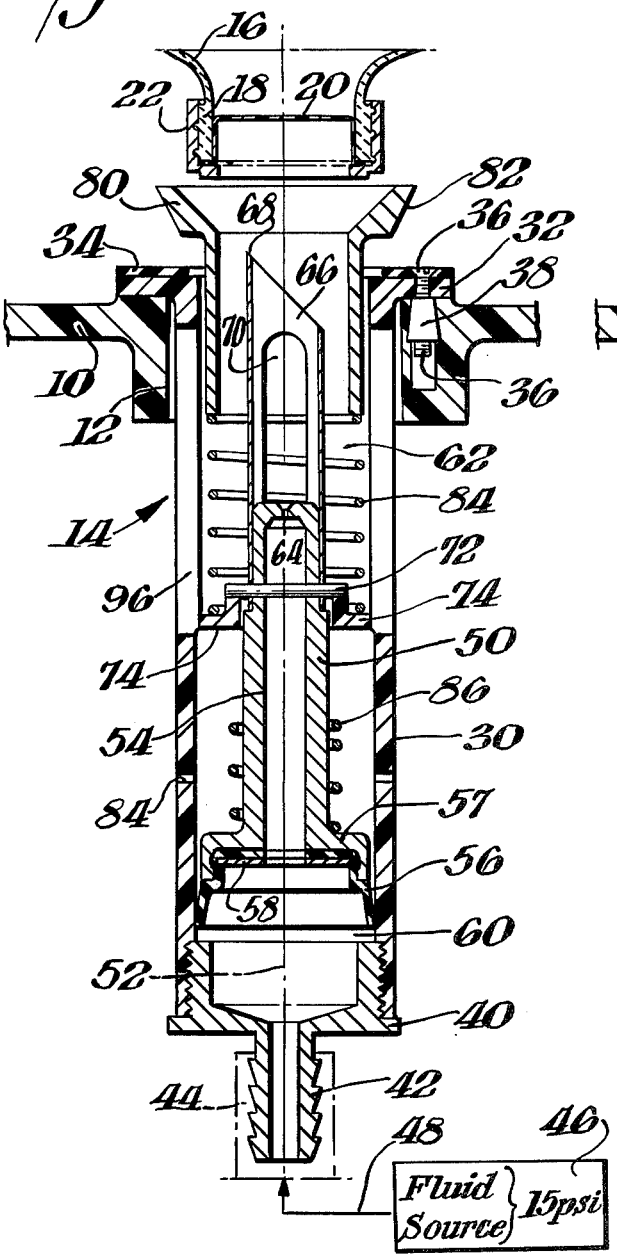
Fig. 3.
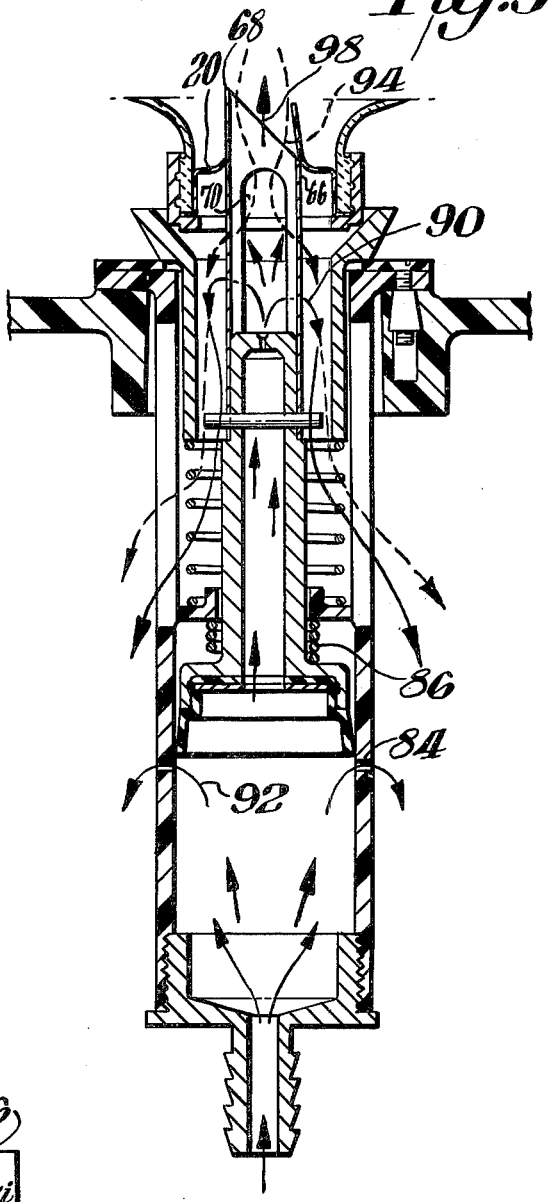

FLUID DISPENSING AND MIXING APPARATUS

BACKGROUND OF THE INVENTION

This invention relates to a diluting and mixing apparatus and, more particularly, to a hydraulic apparatus which is automatically operated to dilute and mix the fluid contents of a container with a second fluid.

Many devices have been built for the photographic and other industries in which the various processing chemicals are supplied in concentrated form. It then becomes necessary for the operator to open the concentrate, dilute it, and/or mix it with other fluids prior to use. In addition to the possibility of error in the dilution, a problem exists, particularly in the photographic field, because of the caustic nature of many of the chemicals used. Photographic chemicals can cause damage to clothing, and even worse, injury to the operators handling the same.

For this reason, various devices have been made to semi-automatically and, in some cases, automatically, empty the concentrate into a reservoir for mixing and subsequent use. Typical of such devices are those described in U.S. Pat. No. 3,688,399, issued Sept. 5, 1972, to Lloyd A. Mengel and U.S. Pat. No. 2,979,231, issued Apr. 11, 1961, to J. Witherspoon, Jr. Devices of this type utilize a puncturing knife, either manually or automatically operated, to puncture the concentrate container and allow its contents to drain into a reservoir or into a supply line for dilution and mixing.

Typical of the problems encountered with devices of this general type are that residues tend to build up on the piercing knife. These residues can render puncturing more difficult and cause contamination. Further, if the container is not rinsed prior to its removal, spillage on the operator's person or clothing can occur with the aforementioned injury or damage. Thorough mixing is not always achieved and, even worse, the desired diluent ratios often are not accurately obtained. Residue buildup further aggravates the problem of obtaining the proper dilution and/or mixing ratios.

It is therefore an object of this invention to obviate many of the disadvantages of the prior art mixing and dispensing devices.

Another object of this invention is to provide an improved apparatus for dispensing and mixing chemicals.

SUMMARY OF THE INVENTION

In accordance with a preferred embodiment of the invention, an apparatus is provided for dispensing a first fluid from a container and mixing it with a second fluid. The apparatus comprises a housing having an axis, a piston movable in the housing along the axis, dividing the housing into driving and mixing chambers, and defining an orifice interconnecting the chambers, a piercing member secured to the piston, means to position a container of the first fluid on the axis of said housing for puncture by the piercing member, and means for introducing the second fluid under pressure into the driving chamber for driving the piston to pierce the container, thereby intermixing the second fluid with the first fluid in the mixing chamber.

In a particularly preferred embodiment of this invention, the housing is mounted in the upper portion of a storage reservoir for the diluted chemicals. The chemical container may be placed on top of the housing. Thus, when the piercing member is actuated, the container is pierced, permitting chemicals to flow down into the mixing chamber and out through orifices provided therein to the storage reservoir. At the same time, the second fluid, which actuates the piercing member, passes through the orifice in the driving piston into the same mixing chamber to continuously mix with the chemicals as the container is being emptied. Once the container is emptied, the reduced back pressure permits the orifice to direct the second fluid as a jet up into the container, wash the container, and remove any residual material. By controlling the flow cycle accurate diluent ratios may be obtained with the assurance that all of the material is removed from the container and the container washed. This reduces the possibility of injury either to the person or damage to the clothing due to accidental spillage of residual chemicals upon removal of the empty container.

BRIEF DESCRIPTION OF THE DRAWINGS

Further advantages and features of this invention will become apparent upon consideration of the following description wherein:

FIG. 1 is a pictorial representation of a dispensing and mixing apparatus constructed in accordance with a preferred embodiment of this invention;

FIG. 2 is a cross-sectional elevation view of the cylindrical housing of the apparatus depicted in FIG. 1 in a rest position prior to placement of a chemical container thereon; and FIG. 3 is a cross-sectional elevation view of the cylindrical housing depicted in FIG. 2 in an operated condition, particularly showing the fluid flows during and after the container is emptied of chemicals.

DESCRIPTION OF THE PREFERRED EMBODIMENTS

There may be seen with reference to FIGS. 1 and 2 a storage reservoir 10 (only the upper portion of which is shown fragmentarily) having a top opening 12 formed therein. The storage reservoir may be made of any suitable material, such as a plastic or stainless steel, which is not reactive with or affected by the chemicals to be stored. For photographic applications, this reservoir may be the storage reservoir of an automatic film processor, for example.

The opening 12 is configured to accommodate an automatic dispensing and mixing device 14 constructed in accordance with this invention. The mixing device of this invention is adapted for dispensing the chemicals from and washing a container 16, also shown fragmentarily. The container 16, which may contain a photographic processing chemical by way of example, is seen to have a threaded mouth 18 which is sealed by a rupturable seal 20 secured by an annular cap 22 (the flat portion of the cap is seen to be open to permit access to the rupturable seal). The seal itself may be made of any suitable material, such as polypropylene. Likewise, the container and cap may be made of any suitable material such as an acrylic plastic.

In use, the container 16 is inverted, as depicted in FIG. 2 for example, and placed on the mixing device 14. When the device 14 is actuated, the rupturable seal 20 is automatically punctured, allowing the contents of the container to drain into and through the mixing device for mixing with water or other suitable diluent or mixing fluid or chemical and subsequent storage in the storage reservoir. Following the emptying of the container, the inside of the container is sprayed with a jet spray of the diluent for cleaning (or mixing), after which it also drains down into the storage reservoir 10. Knowledge and control of the flow rate of the diluent or the diluted fluid level permits a known amount of diluent to be mixed with a known amount of chemical from the container to provide a precisely determined ratio. Furthermore, the container is now clean and free of chemicals such that when the container is removed, spillage upon the equipment or the operator causes little or no damage or injury.

The details of the mixing device 14 will now be described. It comprises a cylindrical housing 30, the upper end of which has a mounting flange 32 adapted to be supported by the opening 12 in the reservoir 10. The housing 30 is secured to the top of the reservoir 10 by a retaining ring 34 and screws 36. The screws may be secured by expansion plugs 38, or other suitable means, to the storage reservoir. In a preferred embodiment, the housing is cylindrical and has a longitudinal axis 52. The upper portion (in the drawing) of the housing is provided with longitudinal wall slots 96. These slots extend down to an inner annular flange 74 formed in the middle of the housing. The lower end (in the drawing) of the housing 30 is internally threaded to accommodate a cap 40 having a nib 42 at the lower portion thereof to provide fluid access. Suitable tubing 44 is placed over the nib 42 so that the housing may be supplied with a suitable diluent or mixing fluid (water as used in the case of photographic chemicals will be referred to in the remaining description) from a fluid source 46 through the tubing depicted by the line 48. The fluid source 46 provides the diluent fluid typically at a minimum pressure of 15 psig. To provide the various dilution ratios desired, the volume may be controlled by a suitable liquid level control in the reservoir such as a float (not shown). Alternatively, the flow rate from the source 46 may be controlled and the period of flow timed to achieve the desired dilution ratio.

Inside the housing 30 is disposed a drive piston 50 adapted to move along the axis 52 of the housing. The housing axis is in alignment with, i.e., intersects, the container seal 20. In the case of a circular seal, it is preferred that the axis of the housing intersects the center of the seal. The drive piston 50 is hollow as at 54 to provide a passage for fluid and has its lower end (in the drawing) enlarged in a cup-like fashion and generally conforms to the inside cross-sectional shape of the housing. It is adapted to accommodate a suitable seal 56 which can be made of a material such as silicone rubber. A retaining ring 58 is adapted to fit within an annular groove formed within the upper region of the cup-like end 57 to retain the seal in place. In this manner, the interior of the cylindrical housing is divided into two portions: a drive chamber 60 in the lower portion thereof, and a mixing chamber 62 in the upper portion thereof. The piston itself has a loose sliding fit in the housing while the seal 56 is adapted to engage the inner wall of the housing to prevent the passage of fluids around the piston and facilitate the piston driving action.

The upper end of the piston has a jet or spray orifice 64 formed therein, preferably on the axis 52, to permit a stream of the diluent fluid or water to pass therethrough and, as will be described, up into the interior of the container 16 when it is empty. The spray aids in washing the container and removing any residual material therefrom. The upper end of the piston has a reduced diameter to accomodate a hollow cylindrical piercing member or knife 66 which may be press-fitted thereover. The knife 66 has a sharpened point 68 and its sides are open as depicted at 70 to permit fluid to flow freely therethrough. To secure the knife and also to provide a stop for the downward movement of the piston, a stop pin 72 is used. The stop pin is adapted to rest, in its lower-most position as depicted in FIG. 2, on the inner flange 74 formed within the interior mid-portion of the cylindrical housing 30.

A guard ring 80 which is funnel-like in shape (having a flared lip 82) is positioned slideably in the upper end of the cylindrical housing 30 to protect the tip of the knife against injuring people. To this end, the guard ring 80 is springloaded by a compression spring 84, the lower end of which rests upon the inner flange 74, the upper portion of which contacts the lower portion of the guard ring 80. The guard ring is retained in the housing by flats (not shown) on the retaining ring 34 adapted to cooperate with the corresponding flats (not shown) on the outer wall of the guard ring, to limit the upward extent of movement of the guard.

The drive piston 50 is permitted to move freely through the opening defined by the inner flange 74 and there is some fluid leadage between the flange 74 and the piston 50. Any such leadage is reduced by the fact that the fluid in the drive chamber is pressurized. It also is to be noted that there may be some minimal leaking about the seal 56. The affect of such leakage, particularly when the piston is in the up position, as depicted in FIG. 3, is reduced by forming radial escape orifices 84 in the lower middle portion of the housing 30 so that some of the pressurized fluid may flow therethrough. This flow flushes out any fluid passing around the seal from the upper or mixing chamber 62.

The material used for the housing and other parts of the mixing device may be any suitable material that is non-reactive or inert to the particular chemicals used. In the case of photographic chemicals, the housing and the several parts therein may be formed of ABS plastic (acrylonitrile/butadiene/styrene). The springs, as well as the stop pin may all be formed of a stainless steel. A return spring 86 may be placed about the drive piston 50 in the lower chamber to accommodate its return to the lower position. Alternatively, this may be accomplished by gravity when the piston is vertically oriented, which of course is the preferred orientation to insure rapid and complete evacuation of the container.

In operation, the container 16 is inverted, as depicted in FIG. 2, and placed on the guard 80. The weight of the container depresses the guard to the position depicted in FIG. 3, compressing the compression spring 84.

The fluid from the fluid source 46 is now applied under pressure into the drive chamber 60 causing the drive piston and knife to move upwardly along the axis of the chamber until the knife 66 punctures the seal 20. The upward movement of the piston stops when the end portion 57 of the piston strikes the inner flange 74 (limited by spring 86). This permits some fluid to flow out through the escape orifices 84 thereby carrying with it any fluid leakage which occurs about the seal 56. The remaining pressurized fluid passes through the hollow piston 50, through the spray ofifice 64, and into the mixing chamber 62. This flow is depicted by the solid lines 90. The fluid escaping through the escape orifices 84 is depicted by the solid lines 92. The downward flow of chemicals from the ruptured container 16 is depicted by the dashed lines 94. The back pressure of the fluid 94 escaping from the container, which flows down into and around the outer portion of the piston and out through the longitudinal wall slots 96, affords a mixing action between the chemicals 94 and the sprayed diluent fluid 90 as it flows into the storage reservoir. Once the container is empty and the back pressure removed, the fluid flow through the spray jet orifice 64 is directed, as depicted by the heavy solid arrow 98, upwardly into the container as a jet or spray to wash the interior of the container.

When sufficient diluent fluid has flowed into the system, as determined say by a float in the reservoir, to provide the desired dilution ratio, the diluent fluid flow is terminated. The container is now free and clean of all chemicals. With the water pressure released, the return spring 86 forces the piston downwardly to its original position. Residual fluid in the piston escapes through the orifice 64. The fluids are now thoroughly and actively mixed and stored within the storage reservoir 10.

The flowing of fluid through and about the knife causes it to be similarly cleaned and free of chemicals so that it is not contaminated or encrusted as knives of the prior art often have been. In short, all chemicals within the container are now transferred into the storage reservoir. The container is clean and may be removed with little danger or damage to an operator's clothing or injury to his person.

We claim:

1. Apparatus for dispensing a first fluid from a container and mixing said first fluid with a second fluid comprising:

a housing having an axis, a piston movable in said housing along said axis and dividing said housing into driving and mixing chambers, said piston defining a first orifice interconnecting said chambers, a piercing member secured to said piston, means communicating with said mixing chamber to position a container of a first fluid on said axis of said housing for puncture by said piercing member, and means for introducing a second fluid under pressure into said driving chamber for driving said piston along said axis to puncture said container positioned for puncture and to intermix said first fluid and said second fluid from said first orifice.

2. Apparatus according to claim 1 wherein said piercing member is hollow, elongated, and has an axis parallel to said housing axis, said first orifice lying on and being in the direction of said piercing member axis, whereby said second fluid is injected into said container positioned for puncture, upon removal of said first fluid, to wash said container.

3. Apparatus according to claim 2 wherein said piercing member and said housing axes coincide.

4. Apparatus according to claim 3 wherein said hollow piercing member defines side orifices communicating with said mixing chamber for permitting said fluids to pass into said mixing chamber for mixing.

5. Apparatus according to claim 1 wherein said drive chamber defines escape orifices to facilitate the removal therefrom of any of first fluid passing between said chambers.

6. Apparatus according to claim 5 which also includes resilient means for withdrawing said piston from said container positioned for puncture.

7. Apparatus according to claim 6 which also inludes a storage reservoir defining a second orifice, said housing being secured in said second orifice of said storage reservoir to discharge the mixed first and second fluids into said reservoir from said mixing chamber.

8. Apparatus according to claim 7 which also includes a springloaded guard slideable along said axis in the mixing chamber portion of said housing to protect said piercing member, said guard being adapted to receive said container to be punctured.

9. Apparatus according to claim 1 wherein said piercing member and said first orifice both lie on said housing axis.

10. Apparatus according to claim 9 wherein said drive chamber defines escape orifices to facilitate the removal therefrom of any of first fluid passing between said chambers.

11. Apparatus according to claim 1 which also includes a storage reservoir defining a second orifice, said housing being secured in said second orifice of said storage reservoir to discharge the mixed first and second fluids into said reservoir from said mixing chamber.

* * * * *